US005863353A

United States Patent [19]

Snipe, Jr.

[11] Patent Number: 5,863,353

[45] Date of Patent: Jan. 26, 1999

[54] WINDOW HELPER AND METHOD OF USING SAME

[76] Inventor: Louis Horace Snipe, Jr., 1336 N. Frazier St., Philadelphia, Pa. 19131

[21] Appl. No.: 722,967

[22] Filed: Sep. 30, 1996

[51] Int. Cl.[6] ..... A47L 4/04; B08B 13/00

[52] U.S. Cl. ..... 134/42; 15/268; 248/121

[58] Field of Search ..... 15/1, 257.01, 268; 211/87.01, 104, 205; 248/121, 122.1, 176.1; 269/17, 43, 249

[56] References Cited

U.S. PATENT DOCUMENTS 2,407,837 9/1946 Kissel ..... 292/339
2,506,508 5/1950 Kmita ..... 292/339
2,766,960 10/1956 Weber ..... 292/339
3,087,186 4/1963 Budd ..... 15/268
4,973,093 11/1990 Olszowka ..... 292/339

*Primary Examiner*—Mark Spisich
*Attorney, Agent, or Firm*—Patent & Trademark Services; Joseph H. McGlynn

[57] ABSTRACT

A pair of supports with a platform at the top of each support. The platforms hold the top and bottom tilt in type windows so they can be easily cleaned. The top support also has a clamp to make it easier to hold the bottom window while cleaning the top window.

4 Claims, 1 Drawing Sheet

WINDOW HELPER AND METHOD OF USING SAME

BACKGROUND OF THE INVENTION

This invention relates, in general, to a portable window sash support and, in particular, to a portable window sash support to be used with tilt type double hung window sashes to prevent damage to the tilted sash, the track mechanism which allows the sash to tilt in, damage to the vinyl or wood sash, insulated glass seals and the finish of the window sill itself.

DESCRIPTION OF THE PRIOR ART

In the prior art various types of devices which can be used with windows have been proposed. For example, U.S. Pat. No. 2,407,837 discloses a stop which is designed to hold a vertically sliding window in a partially raised position. The stop consists of a pole having a spring biased clip which will allow the clip to be moved to any position along the pole and held in position by the clips resiliency. The clip has a projection portion which engages the bottom of the window to hold the window in position.

U.S. Pat. No. 2,506,508 discloses a telescoping stop for a vertically sliding window which holds the window in a partially raised position. The stop has a series of notches which allow the height of the stop to be adjusted to hold the window in a variety of positions.

U.S. Pat. No. 2,766,960 discloses a portable holding device for holding open a vehicle trunk. The holding device has a first part adapted to be clamped to a part of the vehicle and an elongated rod pivotably mounted thereto. The rod is designed to be adjusted to different heights and different angles with respect to the first part.

U.S. Pat. No. 4,973,093 discloses a device for securing a door consisting of a vertical shaft, one end of which is secured to the door handle and the opposite end has a pad which is secured to the floor.

However, none of the prior art devices have been designed to support a tilt-in window to aid in holding the window at the proper height so a person can clean the window in an efficient and safe manner.

The new type of "tilt-in" double hung sash windows were created so a person could clean the outside glass from the inside of the house. While this type of window solves a very real problem for the homeowner, it also creates another. When it is time to clean the outside of the window, the homeowner must support the tilted in window sash with one hand and clean it with the other, because there is at present, nothing to hold the window in a convenient, horizontal position for cleaning.

When a person wants to clean the upper and lower windows, the lower window is tilted in first, then the upper window is tilted in on top of the lower window. Supporting the combined weight of both windows can be a formidable task, especially in view of the fact that modern windows may contain double or even triple pane glass.

If the sashes are allowed to go to the full downward tilted in position, which occurs when the bottom sash comes into contact with the inside window sill, the leverage created by this arrangement exerts a tremendous amount of pressure on the tilted sash (at the point of contact with the window sill) and the track mechanism which allows the window to tilt in. This arrangement can cause damage to the vinyl or wood sash, the insulated glass seals, or the finish of the sill itself. Another problem is the very expensive glass, that is in the window, may break.

In the case of larger windows, it is impossible to support the lower sash with one hand and unlock the upper sash so it can be tilted in. The operation necessary to unlatch the windows requires the use of both hands.

SUMMARY OF THE INVENTION

The present invention comprises a pair of supports with a platform at the top of each support. The platforms hold the top and bottom tilt in type windows so they can be easily cleaned. The top support also has a clamp to make it easier to hold the bottom window.

It is an object of the present invention to provide a portable window support for tilt-in windows.

It is an object of the present invention to provide a portable window support which protects the window when it is in the tilted-in or cleaning position.

It is an object of the present invention to provide a portable window support which is inexpensive and easy to use.

These and other objects and advantages of the present invention will be fully apparent from the following description, when taken in connection with the annexed drawings.

DESCRIPTION OF THE PREFERRED EMBODIMENT

Figure 1:
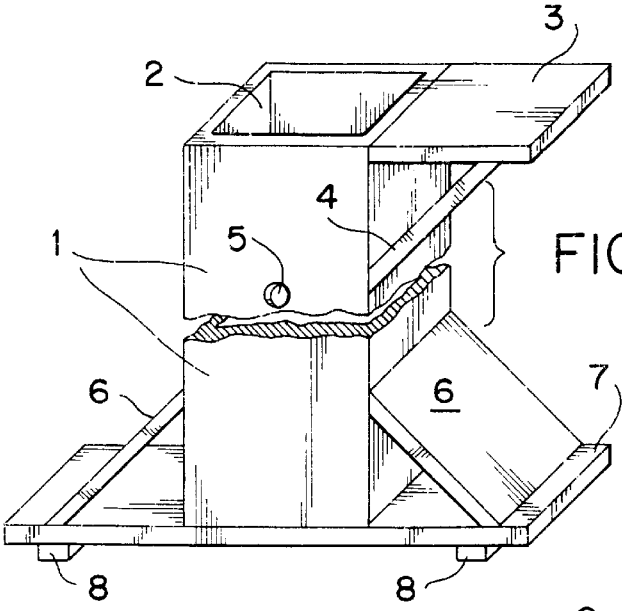
FIG. 1 is a perspective view of one of the supports of the present invention.

Referring now to the drawings in greater detail, FIG. 1 shows a base support 1 which consists of tube with a central aperture 2 generally centrally disposed. The tube could be made from any generally rigid material such as, but not limited to, metal or plastic. The support has an aperture 5 in one side, which extends through to the other side, for purpose to be explained below. Attached to one side of the support 1 is a support platform 3, which can be covered with a cushioning material (not shown) such as rubber or plastic to protect the tilt-out window.

The support platform 3 can be supported by a brace 4 secured between the platform and the side of the support 1. The support 1 has a base 7 which should be wider than the support to provide a stable support when a window is placed on the platform 3. The support 1 can be secured at the bottom by braces 6 which are similar to brace 4 for the platform 3. Attached to the base 7 is four pads 8 to protect the floor surface, that the window helper may be placed on, from scratches.

It should be noted that the support 1, platform 3 and the braces 4 and 6 are shown as separate elements that can be attached by any conventional means. However, all of the elements could be molded as a unitary structure without departing from the scope of the invention.

Figure 2:
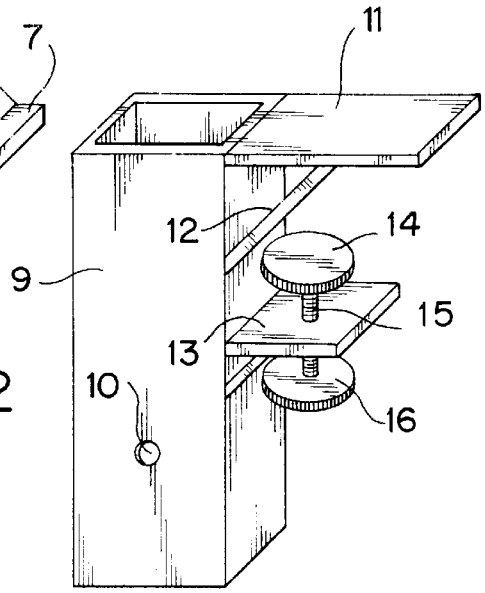
FIG. 2 is a perspective view of the other support of the present invention.

The second part of the window helper is shown in FIG. 2, and consists of a second tube 9 with an outside diameter which will fit snugly into the aperture 2 in support 1. The fit between the two supports should be snug, but also, the support 9 should be able to move without too much resistance so that it will be difficult to slide up and down in support 1. An aperture 10 is positioned in the side of support 9, and extends through to the other side, and which will register with aperture 5 when the two supports are telescoped. In this manner, a pin (not shown) can be placed in the aligned apertures to hold the two supports in assembled condition.

The second support 9 has a support platform 11 and brace 12 which are similar to platform 3 and brace 4 on the support 1, and that serve the same purpose. In addition, an adjustable vise is attached to the support 9 just below the platform 11. The vise consists of a base 13 which has a threaded aperture therethrough. Secured within the aperture is a threaded shaft 15 which has a protective pad 16 on one end and a turning knob 14 on the opposite end. When a window 18 (see FIG. 3) is placed between the platform 3 and the knob 14 is tightened, the window 18 will be held securely while the window 17 is cleaned.

The support 1 is approximately 36 inches tall and the aperture 5 is ⅜ inches in diameter, and is placed in the center of the support 1 about 2 inches from the top. Support 9 is 28 inches tall and even on all sides, and the aperture 10 is about 10 inches from the top of the support. The vise should be placed about 5 inches above the aperture 10. The platform 3 extends about 3 inches from the side of support 1, and the platform 11 extends about 4½ inches from the side of the support 9. However, it should be understood that the above dimensions are given as illustrations only, and the dimensions could be changed without departing from the scope of the invention.

In order to use the window helper, a user would raise the bottom window 18 up about 3 inches and bring the top window 17 down about 11 inches from the bottom of the window sill. The inside of the bottom window 18 can now be cleaned, and then the bottom window can be tilted out and allowed to rest on the top of platform 3 and the outside of the bottom window can now be cleaned. The support 1 will hold the bottom window in a horizontal position so the user can have both hands free to clean and he/she does not have to support the bottom window with one hand while cleaning with the other hand.

Figure 3:
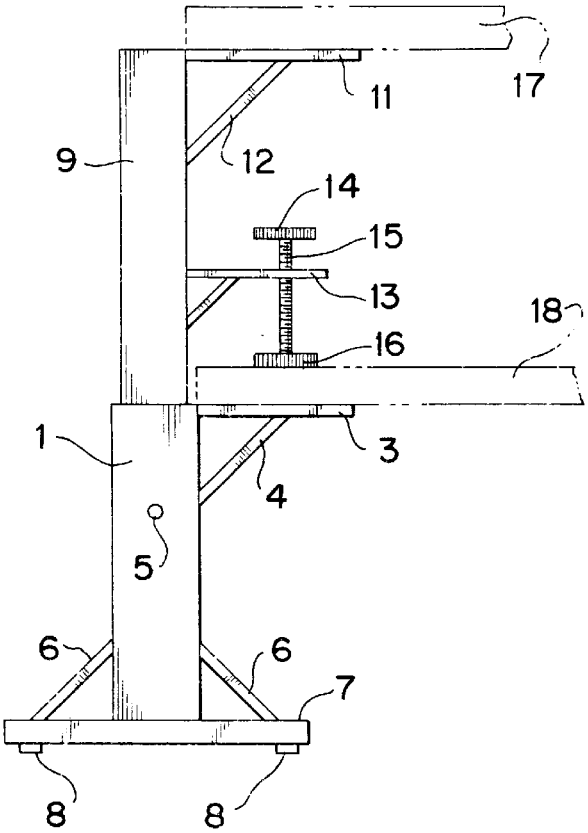
FIG. 3 is a side view of the present invention holding a pair of windows.

After the bottom window 18 has been cleaned, the inside of the top window 17 can be cleaned. Next, the bottom window can be raised enough to unlock the top window, and tilt it into the room. Both windows can now be rested on the platform 3 temporarily. Now top window 17 will be raised while support 9 is placed into the aperture 2 in support 1. The top window can now be placed on platform 11, the apertures 5 and 10 can be aligned and a pin can be inserted into the apertures to secure the two supports. Knob 14 can now be turned which will force pad 16 against the top of window 18, thereby securely holding window 18 against the platform 3, as shown in FIG. 3. The outside of window 17 can now be cleaned. Once cleaned the process can be reversed and the windows tilted back into the window frame.

Although the Window Helper and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A support for tilt-in windows adapted to support said windows while they are being cleaned, comprising:

a first support member having an open top, a bottom and sides, said first support member being hollow, a platform attached to one of said sides of said first support member, an aperture extending through another of said sides of said first support member, a second support member having an outside dimension which will fit into said hollow first support member, said second support member having a top, a bottom and sides, an aperture extending through one of said sides of said second support member, and clamp means attached to another of said sides of said second support member, and a platform attached to the same side as said clamp means, whereby a first tilt out window is adapted to be supported on said platform attached to said first support member and clamped thereto by said clamp means, and a second tilt out window can be supported on said platform attached to said second support member.

2. The support for tilt-in windows as claimed in claim 1, wherein said clamp means is a screw operated clamp.

3. The support for tilt-in windows as claimed in claim 2, wherein a horizontal support is attached to said second support member and said clamp means is attached to said horizontal support.

4. A method of using the support for tilt-in windows as claimed in claim 1, wherein said method comprises:

cleaning an inside surface of a first tilt-in window, tilting said first tilt-in window until it rests on said platform attached to said first support member, cleaning an outside surface of said first tilt-in window, cleaning an inside surface of a second tilt-in window, placing said second support member into said first support member, clamping said first tilt-in window between said clamp means and said platform attached to said first support member, tilting said second tilt-in window until it rests on said platform attached to said second support member, cleaning an outside surface of said second tilt-in window.

* * * * *